US011402093B2

(12) United States Patent
Akbarimonfared et al.

(10) Patent No.: US 11,402,093 B2
(45) Date of Patent: Aug. 2, 2022

(54) FUEL/AIR MIXTURE AND COMBUSTION APPARATUS AND ASSOCIATED METHODS FOR USE IN A FUEL-FIRED HEATING APPARATUS

(71) Applicant: Rheem Manufacturing Company, Atlanta, GA (US)

(72) Inventors: Amin Akbarimonfared, Fort Smith, AR (US); Timothy J. Shellenberger, Tyronne, GA (US); Robert Steven Neihouse, Fort Smith, AR (US); Scott Alan Willbanks, Fort Smith, AR (US); Darryl Farley, Fort Smith, AR (US); Nathan Taylor Whalen, Alma, AR (US); Shawn Allan Reed, Charleston, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 136 days.

(21) Appl. No.: 16/799,265

(22) Filed: Feb. 24, 2020

(65) Prior Publication Data

US 2020/0191388 A1 Jun. 18, 2020

Related U.S. Application Data

(60) Continuation of application No. 15/649,454, filed on Jul. 13, 2017, now Pat. No. 10,571,122, which is a (Continued)

(51) Int. Cl.

| | |
|---|---|
| ***F23D 14/70*** | (2006.01) |
| ***F23D 14/08*** | (2006.01) |
| ***F24H 9/00*** | (2022.01) |

(52) U.S. Cl.

CPC ..... *F23D 14/70* (2013.01); *F23D 14/08* (2013.01); *F24H 9/0052* (2013.01)

(58) Field of Classification Search

CPC ..... F23D 14/70; F23D 14/08; F24H 9/0052

See application file for complete search history.

(56) References Cited

U.S. PATENT DOCUMENTS

| | | | | |
|---|---|---|---|---|
| 1,902,970 A * | 3/1933 | Ramsaur | ..... | F01M 5/007 165/95 |
| 2,249,271 A | 7/1941 | Davis | | |

(Continued)

FOREIGN PATENT DOCUMENTS

| | | |
|---|---|---|
| JP | 06249408 A | 9/1994 |
| JP | 3284518 A | 5/2002 |

OTHER PUBLICATIONS

European Search Report for Application No. 19171776.8 dated Sep. 30, 2019.

(Continued)

*Primary Examiner* — Steven S Anderson, II

(74) *Attorney, Agent, or Firm* — Eversheds Sutherland (US) LLP

(57) ABSTRACT

A fuel-fired furnace incorporates specially designed fuel/air mixing and combustion structures. The fuel/air mixing structure is of a mixing sound-attenuating design and comprises a venturi having a perforated sidewall portion and being surrounded by a noise-damping housing chamber communicating with the interior of the venturi via its sidewall perforations. During use of the mixing structure, air is flowed through the venturi in a swirling pattern while fuel is transversely injected internally against the swirling air. The combustion structure comprises a burner box housing into which the fuel/air mixture is flowed, combusted, and then discharged as hot combustion gas into and through the heat exchanger tubes. The fuel/air mixture entering the burner box housing initially passes through a non-uniformly perforated diffuser plate functioning to substantially alter in (Continued)

a predetermined manner the relative combustion gas flow rates through the heat exchanger tubes.

20 Claims, 4 Drawing Sheets

Related U.S. Application Data division of application No. 14/084,095, filed on Nov. 19, 2013, now Pat. No. 9,739,483.

(60) Provisional application No. 61/883,031, filed on Sep. 26, 2013.

(56) References Cited

U.S. PATENT DOCUMENTS

| | | | | |
|---|---|---|---|---|
| 3,181,646 | A | 5/1965 | Edwards | |
| 3,701,481 | A | 10/1972 | Reichmann et al. | |
| 3,888,018 | A | 6/1975 | Gaski et al. | |
| 4,690,245 | A | 9/1987 | Gregorich et al. | |
| 4,762,530 | A | 8/1988 | Koziol | |
| 4,773,384 | A | 9/1988 | Koziol | |
| 4,805,587 | A | 2/1989 | Schweitzer | |
| 5,127,824 | A | 7/1992 | Barker | |
| 5,198,625 | A * | 3/1993 | Borla | F01N 1/04 181/248 |
| 5,240,411 | A | 8/1993 | Abalos | |
| 5,274,995 | A | 1/1994 | Horner et al. | |
| 5,291,875 | A | 3/1994 | Koziol | |
| 5,460,512 | A | 10/1995 | Lifshits et al. | |
| 5,546,925 | A | 8/1996 | Knight | |
| 5,791,137 | A * | 8/1998 | Evans | F23R 3/36 60/39.463 |
| 6,022,213 | A | 2/2000 | Harthun | |
| 9,739,483 | B2 * | 8/2017 | Akbarimonfared | F23D 14/70 |
| 9,951,945 | B2 * | 4/2018 | Akbarimonfared | F23D 14/08 |
| 10,571,122 | B2 * | 2/2020 | Akbarimonfared | F23D 14/70 |
| 2002/0166553 | A1 | 11/2002 | Topp | |
| 2004/0121697 | A1 | 6/2004 | Kojima | |
| 2004/0250810 | A1 | 12/2004 | Schultz et al. | |
| 2005/0106517 | A1 | 5/2005 | Okada et al. | |
| 2008/0318174 | A1 | 12/2008 | Leclerc et al. | |
| 2011/0104622 | A1 | 5/2011 | Sherrow | |
| 2011/0220847 | A1 | 9/2011 | Hendershot et al. | |
| 2013/0213379 | A1 | 8/2013 | Schultz et al. | |
| 2014/0202443 | A1 * | 7/2014 | Sherrow | F23D 14/62 126/116 R |
| 2015/0086934 | A1 | 3/2015 | Akbarimonfared et al. | |

OTHER PUBLICATIONS

U.S. Office Action dated Jul. 28, 2016 for U.S. Appl. No. 14/084,095.
International Search Report and Written Opinion issued for PCT/US2014/055381 dated Dec. 16, 2014, 13 pgs.
European Search Report dated May 26, 2017 for EP 14847622.9.
Office Action for Canadian Application No. 3,010,826 dated Jun. 15, 2020.

* cited by examiner

FUEL/AIR MIXTURE AND COMBUSTION APPARATUS AND ASSOCIATED METHODS FOR USE IN A FUEL-FIRED HEATING APPARATUS

CROSS-REFERENCE TO RELATED APPLICATION

The present application is a continuation of U.S. patent application Ser. No. 15/649,454 filed Jul. 13, 2017, which is a divisional of U.S. patent application Ser. No. 14/084,095 filed Nov. 19, 2013, now U.S. Pat. No. 9,739,483 issued Aug. 22, 2017, which claims benefit of the filing date of provisional U.S. application No. 61/883,031 filed Sep. 26, 2013. The entire disclosure of each of the foregoing applications the provisional application is hereby incorporated by reference.

BACKGROUND OF THE INVENTION

The present invention relates generally to fuel-fired heating apparatus, such as fuel-fired air heating furnaces, and more particularly relates to specially designed fuel/air mixing and combustion sections of such fuel-fired heating apparatus.

In fuel-fired heating appliances such as, for example, furnaces, a known firing method is to flow a fuel/air mixture into a burner box structure in which a suitable ignition device is disposed to combust the fuel/air mixture and thereby create hot combustion gases used to heat air (or another fluid as the case may be) for delivery to a location served by the heating appliance. The hot combustion gases are flowed through a series of heat exchanger tubes, externally across which the fluid to be heated is flowed, and then discharged from the heating appliance into a suitable flue structure. Due to various configurational characteristics of the heating appliance, during firing of the appliance undesirable uneven heating of the combustion product-receiving heat exchanger tubes may occur such that an undesirable non-uniform temperature distribution is present in the overall heat exchanger tube array.

In addition to this potential heat exchange unevenness problem, other problems that may arise in the design of fuel-fired heating appliances include an undesirable noise level generated in the creation of the fuel/air mixture delivered to the burner box, an undesirably low level of mixing of the fuel and air, and an undesirably high level of NOx generated in the fuel/air mixture combustion process.

As can be seen, a need exists for alleviating the above-noted problems associated with conventional fuel-fired heating appliances of various types. It is to this need that the present invention is primarily directed.

DETAILED DESCRIPTION

Figure 1:
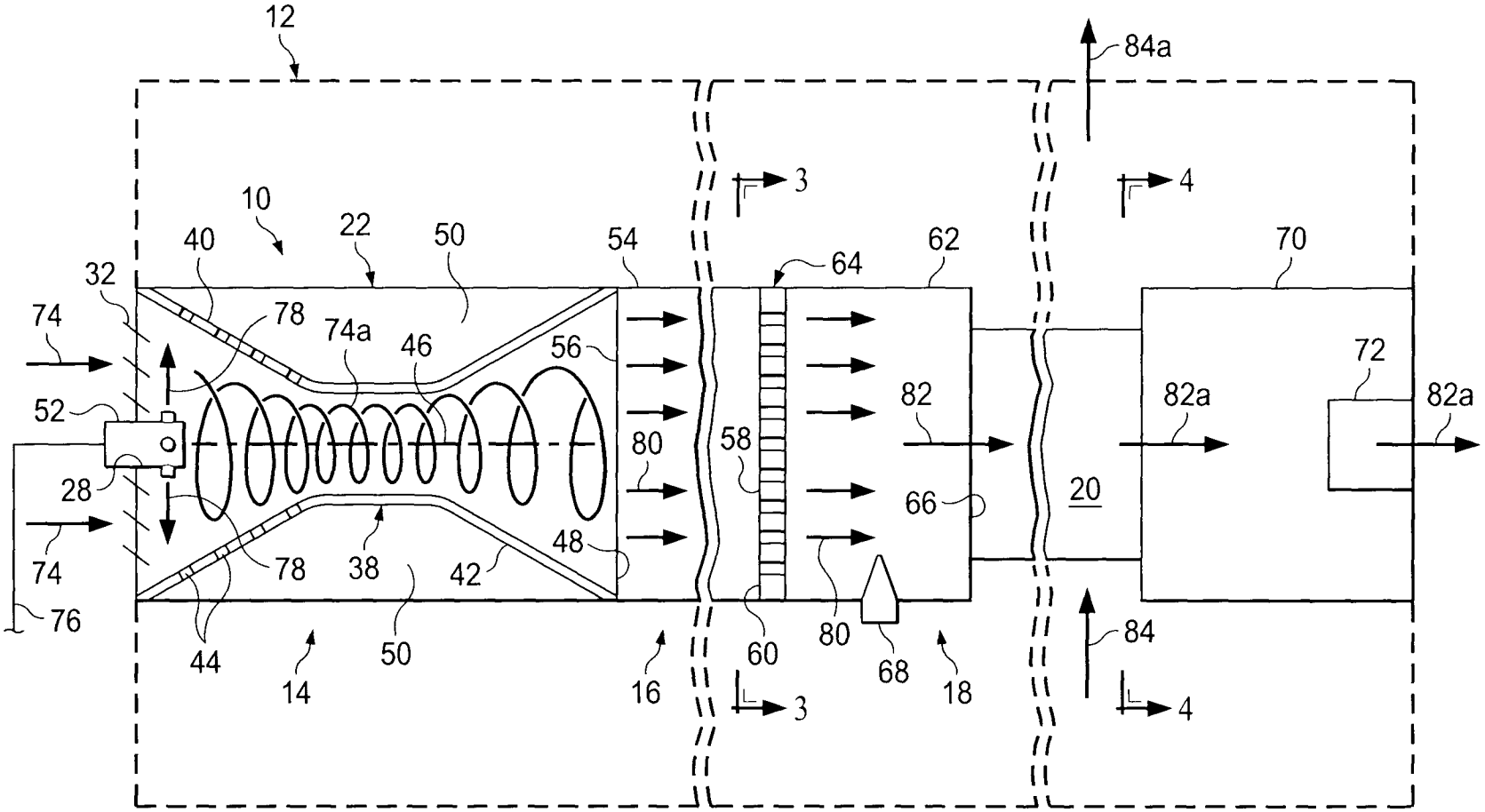
FIG. 1 is a schematic, foreshortened depiction of a fuel-fired heating apparatus embodying principles of the present invention.

A specially designed combustion system 10 of a fuel-fired heating appliance, representatively an air heating furnace 12, is schematically depicted in FIG. 1 and includes, from left to right as viewed in FIG. 1, a primary fuel/air mixing structure 14, a secondary fuel/air mixing structure 16, and a fuel/air mixture combustion structure 18 to which a plurality of heat exchanger tubes 20 (representatively five in number) are operatively connected as later described herein.

Figure 2:
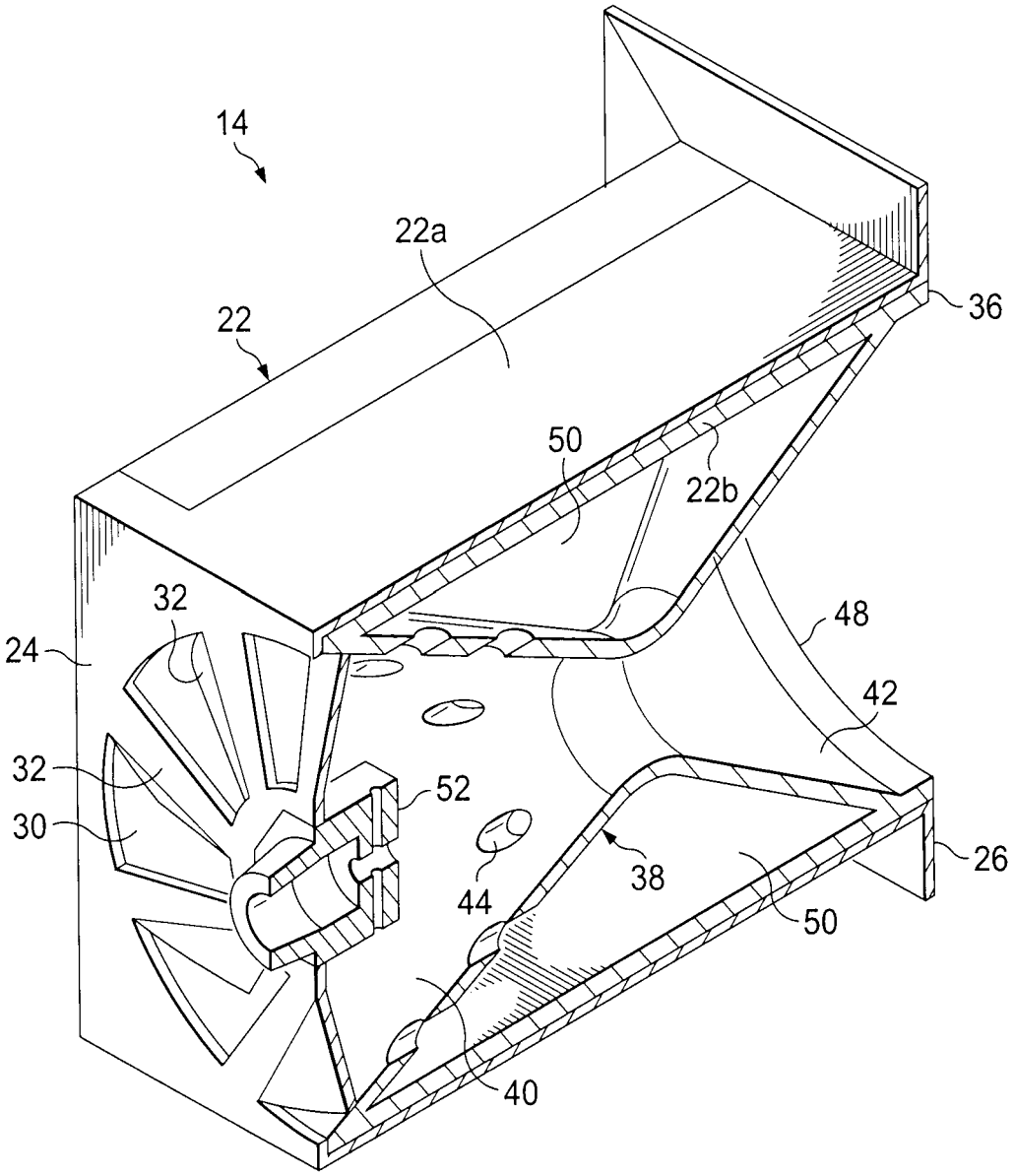
FIG. 2 is a schematic cut-away perspective view of a sound-attenuating primary fuel/air mixing structure portion of the heating apparatus.
Figure 2A:
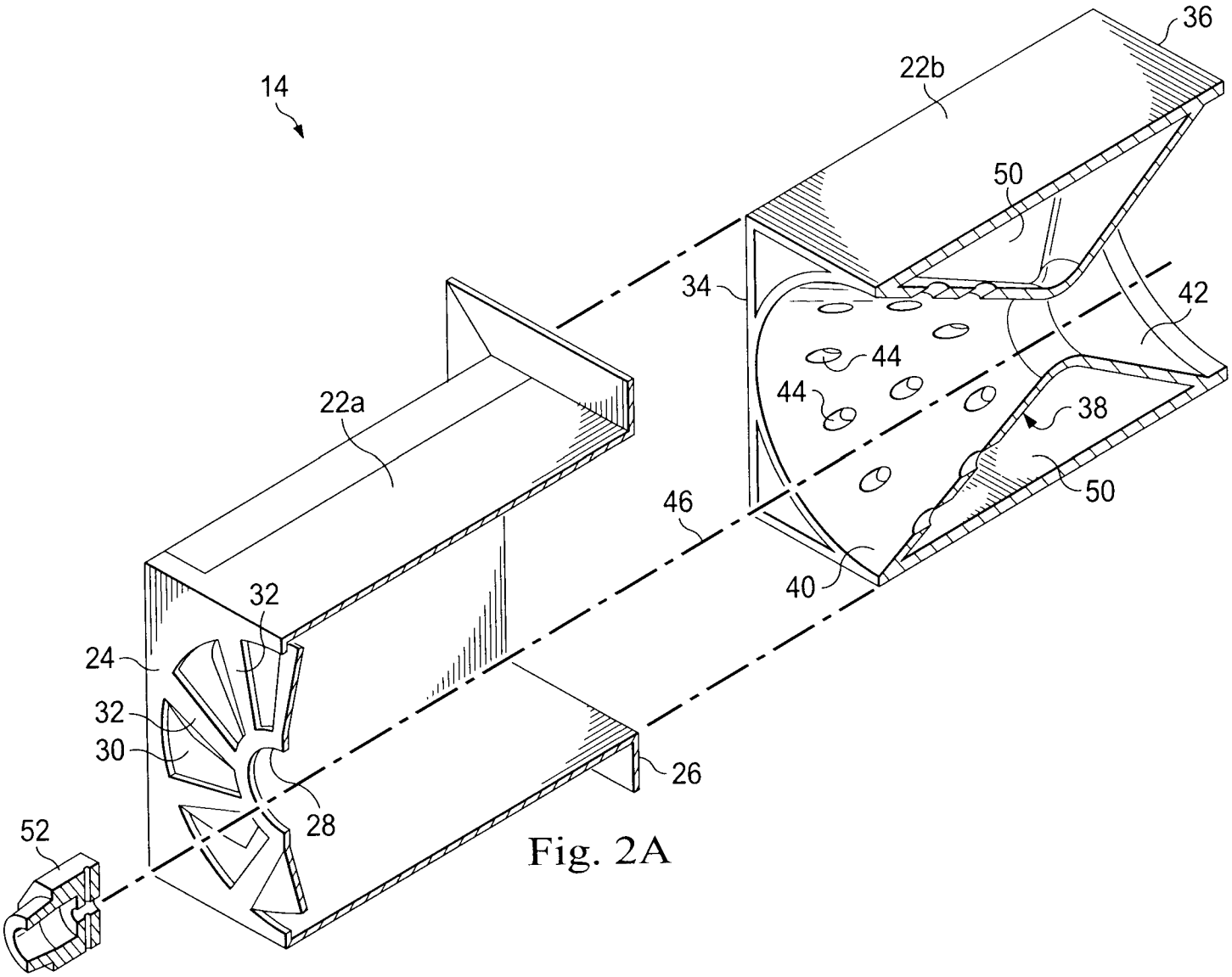
FIG. 2A is an exploded perspective view of the sound attenuating primary fuel/air mixing structure portion shown in FIG. 2.

Referring to FIGS. 1-2A, the primary fuel/air mixing structure 14 disposed at the left end of the combustion system 10 embodies principles of the present invention and comprises a rectangular housing structure 22 having an outer portion 22*a* and an inner portion 22*b* telescoped into the outer portion 22*a* as may be seen in FIGS. 2 and 2A. Outer housing portion 22*a* has an inlet end wall 24 and an open outlet end 26. A central circular opening 28 is formed in the inlet end wall 24 and is circumscribed by an annular end wall opening 30 radially across which an circumferentially spaced array of swirl-inducing vanes 32 radially extends. Inner housing portion 22*b* has open inlet and outlet ends 3436 and laterally circumscribes a venturi structure 38 having enlarged open inlet and outlet end portions 40 and 42.

Venturi structure 38 has perforations 44 formed in its sidewall. Representatively, the perforations 44 are formed only in the inlet end portion 40 of the venturi structure 38, but could be located on additional or other portions of the venturi structure sidewall if desired. As shown in FIGS. 1 and 2A, a longitudinal axis 46 extends centrally through the interior of the venturi structure 38. With the inner housing portion 22*b* telescoped into the outer housing portion 22*a*, the axis 46 extends centrally through the central housing wall opening 28, and the outlet ends 26, 36 of the housing portions 22*a*, 22*b* combinatively define an open outlet end 48 of the overall primary fuel/air mixing structure 14. The inner housing portion 22*b* defines a sound-attenuating chamber 50 that laterally circumscribes the venturi structure 38 and communicates with its interior via the venturi sidewall perforations 44. In the assembled overall housing 22, a radial fuel injector 52 is operatively received in the central housing wall opening 28, and projects axially into the open inlet end portion 40 of the venturi structure 38 for purposes later described herein.

Turning now to FIG. 1, the secondary fuel/air mixing structure 16 comprises a secondary mixing housing 54 having an open inlet end 56 coupled to the open inlet end 48 of the housing 22, and an open outlet end 58 coupled to the open inlet end 60 of a burner box housing portion 62 of the fuel/air mixture combustion structure 18. Positioned at the juncture between the housings 54 and 62 is a specially designed perforated diffuser plate 64 embodying principles of the present invention and uniquely functioning in a manner later described herein. The housing 62 has a closed right end wall 66 spaced apart from and facing the perforated diffuser plate 64. Positioned between the diffuser plate 64 and the end wall 66 is an igniter 68 operative to ignite a fuel/air mixture entering the housing 62 as later described herein.

The previously mentioned heat exchanger tubes 20 form with the fuel/air mixture combustion structure 18 a heat transfer structure portion of the furnace 12 and have, as viewed in FIG. 1, left inlet end portions coupled to the housing 62 end wall 66 and communicating with the interior of the housing 62. As viewed in FIG. 1, right outlet ends of the heat exchanger tubes 20 are communicated with the interior of a collector box structure 70 within which a draft inducer fan 72 is operatively disposed.

Still referring to FIG. 1, during firing of the furnace 12 the draft inducer fan 72 draws combustion air 74 into the open inlet end portion 40 of the venturi structure 38, across the vanes 32, and then rightwardly through the interior of the venturi structure 38. Vanes 32 cause the combustion air 74 to internally traverse the venturi structure 38 in a swirling pattern 74*a* generally centered about the venturi structure longitudinal axis 46. At the same time, the fuel injector 52 receives gaseous fuel via a fuel supply line 76 and responsively discharges gaseous fuel jets 78 radially outwardly into the swirling combustion air 74*a*. The gaseous fuel in the jets 78 mixes with the swirling combustion air 74*a* to form therewith a fuel/air mixture 80 that enters the secondary mixing housing 54 and is further mixed therein.

The fuel/air mixture 80 within the secondary mixing housing 54 is then drawn through the perforated diffuser plate 64 into the interior of the burner box housing portion 62 wherein the igniter 68 combusts the fuel/air mixture 80 to form therefrom hot combustion gas 82 that is flowed rightwardly through the heat exchanger tubes 20.

Simultaneously with the flow of hot combustion gas 82 through the heat exchanger tubes 20, a supply air fan portion of the furnace 12 (not shown) flows air 84 to be heated externally across the heat exchanger tubes 20 to receive combustion heat therefrom and create a flow of heated air 84*a* for delivery to a conditioned space served by the furnace 12. Combustion heat transfer from the heat exchanger tubes 20 to the air 84 causes the tube-entering hot combustion gas 82 to rightwardly exit the heat exchanger tubes 20 as cooled combustion gas 82*a* that enters the collector box 70 and is expelled therefrom, by the draft inducer fan 72, to a suitable flue structure (not shown).

Compared to conventional fuel/air mixing structures, the venturi-based primary fuel/air mixing structure 14 provides several advantages. For example, due to the cross-flow injection technique utilizing the combustion air 74*a* swirling through the venturi interior in combination with the radially directed interior fuel jets 78, an improved degree of fuel/air mixing is achieved within the venturi structure 38. This enhanced degree of fuel/air mixing is further increased by the use of the secondary fuel/air mixing structure 16 which serves to further mix the fuel and air by providing further "residence" time for the fuel/air mixture created in the venturi structure 38 before it enters the fuel/air mixture burner box housing 62 for combustion therein.

Additionally, the construction of the primary fuel/air mixing structure 14 substantially reduces the fuel/air mixing noise during both start-up and steady state operation of the furnace 12. In the primary fuel/air mixing structure 14 the perforations 44 in the sidewall of the venturi structure 38 permit the fuel/air mixture traversing it to enter and fill the chamber 50 circumscribing the venturi structure 38. This creates within the chamber 50 a fluid damping volume that absorbs and damps noise-creating fluid pressure oscillations in the venturi interior, thereby desirably lessening the operational sound level of the primary fuel/air mixing structure 14. Moreover, the enhanced mixing of the fuel/air mixture to be combusted desirably reduces the level of NOx emissions created by the furnace 12 during firing thereof.

Figure 4:
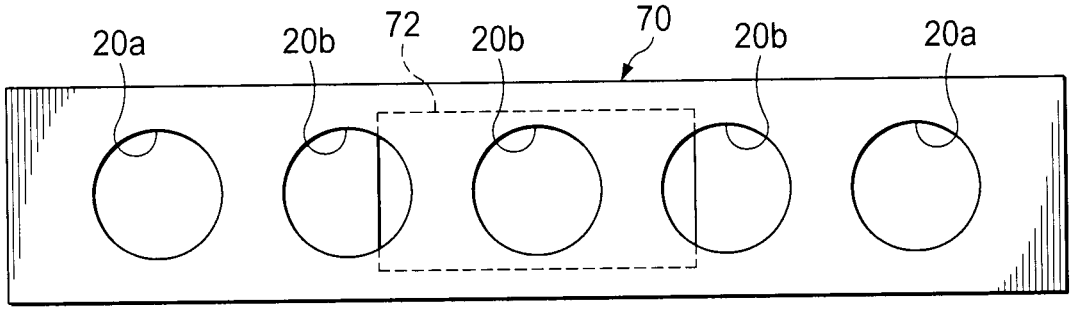
FIG. 4 is an enlarged scale cross-sectional view taken through a heat exchanger tube portion of the fuel-fired heating apparatus taken along line 4-4 of FIG. 1.

As may best be seen in FIG. 4, the draft inducer fan 72 is representatively centered in a left-to-right direction within the collector box 70 and with respect to the five illustratively depicted heat exchanger tubes 20. Accordingly, the suction force of the fan 72 is similarly centered relative to the array of heat exchanger tubes 20. Without the incorporation in the furnace 12 of a subsequently described feature of the present invention, the result would be that the per-tube flow of hot combustion gas 82 is greater for the central tubes 20*b* than it is for the end tubes 22*a*. In turn, this would create an undesirable non-uniform temperature distribution across the heat exchanger tube array, with the central tubes 20*b* having higher operating temperatures than those of the end tubes 20*a*.

Figure 3:
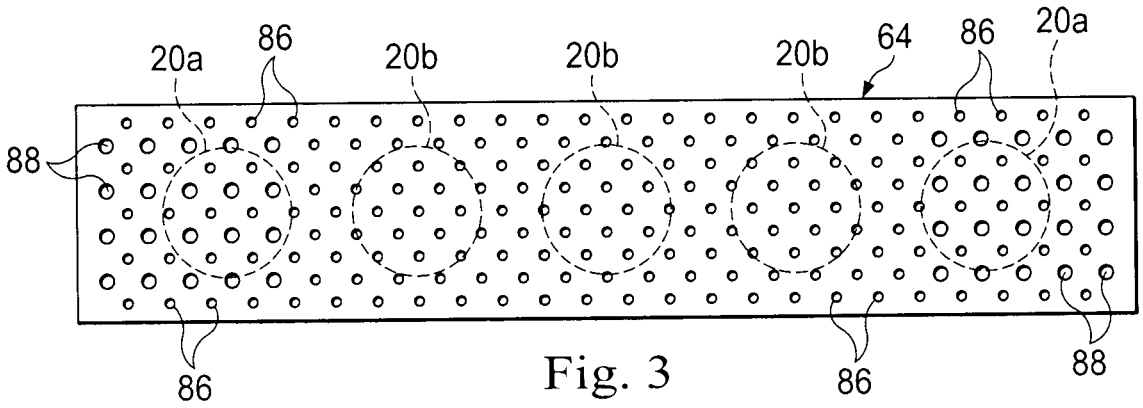
FIG. 3 is an enlarged scale cross-sectional view taken through a burner box portion of the fuel-fired heating apparatus taken along line 3-3 of FIG. 1.

With reference now to FIGS. 1 and 3, the previously mentioned diffuser plate 64 installed at the juncture between the secondary fuel/air mixing housing 54 and the burner box housing 62 representatively has an elongated rectangular shape, and is substantially aligned with the open inlet ends of the heat exchanger tubes 20. Along substantially the entire length of the diffuser plate 64 are formed a series of relatively small perforations 86 (see FIG. 3), with relatively larger perforations 88 being additionally formed through the opposite end portions of the diffuser plate 64. This perforation pattern, as can be seen, provides opposite end portions of the diffuser plate 64 (which are generally aligned with the inlets of the end heat exchanger tubes 20*a*) with greater fuel/air mixture through-flow areas than the diffuser plate fuel/air mixture through-flow areas aligned with the inlets of the central heat exchanger tubes 20*b*.

Accordingly, during firing of the furnace 12, the presence of the diffuser plate 64 lessens the flow of hot combustion gas 82 through the central heat exchanger tubes 20*b* and increases the flow of hot combustion gas 82 through the end heat exchanger tubes 20*a*, with the perforation pattern in the diffuser plate 64 functioning to substantially alleviate non-uniform temperature distribution across the heat exchanger tube array that might otherwise occur. As can readily be seen, principles of the present invention provide a simple and quite inexpensive solution to the potential problem of non-uniform temperature distribution across the heat exchanger tube array. Additionally, in developing the present invention it has been discovered that the use of the non-uniformly perforated diffuser plate 64 also provides for further mixing of the fuel/air mixture 80 entering the burner box housing 62, thereby providing an additional beneficial reduction in the NOx level of the discharged combustion gas 82*a*.

While a particular hole pattern in the diffuser plate has been representatively described herein, it will be readily appreciated by those of ordinary skill in this particular art that a variety of alternative hole patterns and sizes may be alternatively be utilized if desired. For example, while a combination of different size perforation has been representatively illustrated and described, the perforations could be of uniform size but with more perforations/area being disposed on the opposite ends of the diffuser plate 64 than in the longitudinally intermediate portion thereof. Further, the hole pattern could be a non-uniformly spaced pattern to suit the particular application. Additionally, if desired, the diffuser plate hole pattern could have a different overall configuration operative to alter in a predetermined, different manner the relative combustion gas flow rates through selected ones of the heat exchanger tubes 20.

While principles of the present invention have been representatively illustrated and described herein as being incorporated in a fuel-fired air heating furnace, a combustion system utilizing such invention principles could also be incorporated to advantage in the combustion systems of a wide variety of other types of fuel-fired heating apparatus using fire tube-type heat exchangers to heat either a gas or a liquid.

The foregoing detailed description is to be clearly understood as being given by way of illustration and example only, the spirit and scope of the present invention being limited solely by the appended claims.

What is claimed is:

1. A combustion system comprising:

a mixing chamber having an inlet and an outlet;

a fuel injector configured to provide fuel from a fuel source into the mixing chamber;

a burner box in fluid communication with the outlet of the mixing chamber and a plurality of heat exchanger tubes; and a diffuser disposed between the burner box and the plurality of heat exchanger tubes, the diffuser comprising:

a first plurality of apertures generally aligned with an inlet of a first heat exchanger tube of the plurality of heat exchanger tubes, the first plurality of apertures collectively configured to provide a first flow rate and each aperture of the first plurality of apertures having a first outlet area; and a second plurality of apertures generally aligned with an inlet of a second heat exchanger tube of the plurality of heat exchanger tubes, the second plurality of apertures collectively configured to provide a second flow rate that is greater than the first flow rate and each aperture of the second plurality of apertures having a second outlet area that is greater than the first outlet area, wherein the first outlet area and the second outlet area are each less than an inlet area of each heat exchanger tube of the plurality of heat exchanger tubes.

2. The combustion system of claim 1, wherein the first plurality of apertures is arranged in a first configuration and the second plurality of apertures is arranged in a second configuration that is different from the first configuration.

3. The combustion system of claim 1, wherein the first plurality of apertures has a first number of apertures per unit area and the second plurality of apertures has a second number of apertures per unit area that is greater than the first number of apertures per unit area.

4. The combustion system of claim 1, wherein a diameter of at least some of the second plurality of apertures is greater than a diameter of each of the first plurality of apertures.

5. The combustion system of claim 1, wherein the first plurality of apertures is located in a central portion of the diffuser and the second plurality of apertures is located between the central portion and an end of the diffuser.

6. The combustion system of claim 1, wherein diffuser further comprises a third plurality of apertures disposed in a portion of the diffuser that is generally unaligned with any of the plurality of heat exchanger tubes.

7. The combustion system of claim 1, wherein the fuel injector is a radial fuel injector configured to distribute the fuel in a radially outward pattern.

8. The combustion system of claim 1, wherein the mixing chamber comprises a venturi structure disposed therein, the venturi structure including a venturi inlet in fluid communication with the inlet of the mixing chamber and a venturi outlet in fluid communication with the outlet of the mixing chamber.

9. The combustion system of claim 8, wherein the mixing chamber further comprises:

a vane structure disposed proximate the inlet and the venturi inlet, the vane structure comprising a plurality of vanes.

10. The combustion system of claim 9, wherein each of the plurality of vanes is positioned at an angle with respect to a central axis of the venturi structure such that each of the plurality of vanes is configured to direct passing fluid into a generally swirling flow pattern.

11. The combustion system of claim 8, wherein the venturi structure includes a sidewall comprising a plurality of perforations.

12. The combustion system of claim 11, wherein the mixing chamber further comprises a sound-attenuating chamber surrounding at least a portion of the venturi structure, the sound-attenuating chamber being in fluid communication with the venturi structure via the plurality of perforations.

13. The combustion system of claim 1, wherein the first flow rate of the first plurality of apertures and the second flow rate of the second plurality of apertures are both associated with a constant fluid pressure.

14. A diffuser for reducing a NOx level of discharged combustion gases in a fuel-fired heating apparatus, the diffuser comprising:

a first plurality of apertures disposed in a first portion of the diffuser, the first portion extending between a first end of the diffuser to a second end of the diffuser, the first plurality of apertures collectively configured to provide a first flow rate and each aperture of the first plurality of apertures having a first outlet area; and a second plurality of apertures disposed in a second portion of the diffuser, the second portion overlapping the first portion and being configured to align with an outer heat exchanger tube, the second plurality of apertures collectively configured to provide a second flow rate that is greater than the first flow rate and each aperture of the second plurality of apertures having a second outlet area that is greater than the first outlet area.

15. The diffuser of claim 14, wherein the first plurality of apertures is arranged in a first configuration and the second plurality of apertures is arranged in a second configuration that is different from the first configuration.

16. The diffuser of claim 14, wherein the first plurality of apertures has a first number of apertures per unit area and the second plurality of apertures has a second number of apertures per unit area that is greater than the first number of apertures per unit area.

17. The diffuser of claim 14, wherein a diameter of at least some of the second plurality of apertures is greater than a diameter of each of the first plurality of apertures.

18. The diffuser of claim 14, wherein the first plurality of apertures is located in a central portion of the diffuser and the second plurality of apertures is located between the central portion and an end of the diffuser.

19. The diffuser of claim 14, wherein upon installation of the diffuser into the fuel-fired heating apparatus, the first portion of the diffuser is configured to generally align with an inlet of a first heat exchanger tube of the fuel-fired heating apparatus and the second portion of the diffuser is configured to generally align with an inlet of a second heat exchanger tube of the fuel-fired heating apparatus.

20. The diffuser of claim 19 further comprising a third plurality apertures disposed in a third portion of the diffuser, the third portion being generally unaligned with any heat exchanger tube of the fuel-fired heating apparatus.

* * * * *